US009273468B2

(12) United States Patent
Lindgren et al.

(10) Patent No.: US 9,273,468 B2
(45) **Date of Patent: *Mar. 1, 2016**

(54) WINDOW SYSTEM HAVING FLEXIBLE MEANS FOR MOUNTING

(71) Applicant: VKR Holdings A/S, Hørsholm (DK)

(72) Inventors: Claes Lindgren, Farum (DK); Jacob Christian Lund, Vejle O (DK); Niels Adelholm Larsen, Frederiksberg (DK)

(73) Assignee: VKR Holding A/S (DK)

( * ) Notice: Subject to any disclaimer, the term of this patent is extended or adjusted under 35 U.S.C. 154(b) by 0 days.

This patent is subject to a terminal disclaimer.

(21) Appl. No.: 14/472,421

(22) Filed: Aug. 29, 2014

(65) Prior Publication Data

US 2014/0366468 A1 Dec. 18, 2014

Related U.S. Application Data

(63) Continuation-in-part of application No. 13/339,344, filed on Dec. 28, 2011, now Pat. No. 8,833,011.

(30) Foreign Application Priority Data

Dec. 29, 2010 (EP) ..... 10197235

(51) Int. Cl.
*E04D 13/03* (2006.01)
*E06B 1/60* (2006.01)

(52) U.S. Cl.
CPC ..... *E04D 13/031* (2013.01); *E06B 1/603* (2013.01)

(58) Field of Classification Search
CPC ..... E04D 13/0315; E04D 13/031
See application file for complete search history.

(56) References Cited

U.S. PATENT DOCUMENTS

| | | | | |
|---|---|---|---|---|
| 4,603,517 | A * | 8/1986 | Lyons, Jr. | 52/60 |
| 4,726,559 | A * | 2/1988 | Hultmark | 248/237 |
| 4,920,713 | A * | 5/1990 | Borresen et al. | 52/200 |
| 5,188,333 | A * | 2/1993 | Schumacher et al. | 248/676 |
| 6,629,391 | B1 * | 10/2003 | Børresen et al. | 52/200 |
| 6,640,508 | B2 * | 11/2003 | Lindgren et al. | 52/200 |
| 2002/0023396 | A1 * | 2/2002 | Prevot et al. | 52/204.5 |
| 2005/0066579 | A1 * | 3/2005 | Winner | 49/345 |
| 2006/0070316 | A1 * | 4/2006 | Lewis et al. | 52/200 |
| 2008/0115430 | A1 * | 5/2008 | Feucht et al. | 52/200 |
| 2009/0193729 | A1 * | 8/2009 | Kustermann | 52/215 |
| 2012/0049022 | A1 * | 3/2012 | Coyle | 248/220.21 |
| 2012/0073201 | A1 * | 3/2012 | Duffany et al. | 49/62 |
| 2012/0167495 | A1 | 7/2012 | Lindgren et al. | |

FOREIGN PATENT DOCUMENTS

| | | | | |
|---|---|---|---|---|
| EP | 1061199 | A1 * | 12/2000 | E04D 13/03 |
| EP | 2055859 | A1 * | 5/2009 | E04D 13/03 |

* cited by examiner

*Primary Examiner* — Elizabeth A Quast
(74) *Attorney, Agent, or Firm* — Merek Blackmon & Voorhees, LLC

(57) ABSTRACT

The window system has a substantially rectangular frame structure having four corner sections (1*b*) and being adapted to be installed in a roof structure and a bracket arrangement comprising a set of bracket units (6*b*), each bracket unit including a base element (10*b*) mounted at each corner section of the frame structure. Each bracket unit furthermore comprises at least one supplemental element (20*b*,40*b*) adapted to be detachably connected to said base element. One supplemental element comprises a leg element (20*b*) adapted to be detachably connected to the base element, preferably rotatably and detachably connected with the base element.

21 Claims, 13 Drawing Sheets

WINDOW SYSTEM HAVING FLEXIBLE MEANS FOR MOUNTING

The present application is a continuation-in-part of U.S. patent application Ser. No. 13/339,344 filed on Dec. 28, 2011 which claims priority from European Application No. 10197235.4 filed on Dec. 29, 2010. Ser. No. 13/339,344 is hereby incorporated herein by reference in its entirety.

The invention relates to a window system comprising a substantially rectangular frame structure having four corner sections and being adapted to be installed in a roof structure, and a bracket arrangement comprising a set of bracket units, each bracket unit including a base element mounted at each corner section of the frame structure. The invention furthermore relates to a method of installing a window system in a roof structure.

Such window systems are installed in many different roof structures under varying conditions. This applies both to the fastening of the window system itself to the subjacent or surrounding roof structure, and to its relation to other window systems which may be installed side-by-side or opposite the window system in question.

The installation of a single window may be cumbersome in itself. This fact has been elaborated on in the prior art, examples being published international application No. WO 88/04348, in which the window is anchored in the roof structure in the way that a number of angular mounting brackets are by one leg fastened to the side members of the window frame, and the window is then mounted in the roof opening and fastened by the second leg by screws to the subjacent roof structure, the rafters, the counter-battens or the battens. However, varying measurements have to be carried out in order to ascertain correct positioning, and the measuring is an obvious source of error and can be the reason for considerable delays during mounting, as an erroneous measuring implies that the mounting bracket has to be removed after the window has been mounted in the roof opening.

In published international application No. WO 99/35355, this problem has been addressed and solved in that the mounting bracket is formed as a corner fitting in which the first leg portion being formed as two leg sections essentially perpendicular to each other for connection with adjacent frame members at the joint hereof. This document furthermore provides for a solution to the positioning of the window next to and side-by-side other windows. However, even though this installation principle provide for a substantially increased ease of installation relative to the prior art, the mounting bracket disclosed in this document has a limited degree of flexibility with regards to its field of use.

An item of prior art concerned with the increase of flexibility is published international application No. WO 00/65171, in which a multi-purpose fitting for connection of a frame structure of a panel with a support element is described. This document describes a progress over the prior art, in which particularly designed fittings for fixed panels are usually designed as support fittings with oblique sections defining the possible inclination of the panel, whereas in openable panels, the connection is made by especially designed hinge fittings, and solves the problem that fittings of this kind used in panels for construction of e. g. tilted surfaces must be produced in several various forms because of the structure of the known fittings, dependent on whether the panel is to be openable or fixed and on the inclination of the panel. By the multi-purpose fitting of this document, the angle of inclination of the panels is adjusted by means of a separate mounting and hinge fitting, the support element can be produced as a standard product, and the adjustment of the fitting according to the desired inclination can be effected at any time, e.g. on the building site where the final mounting takes place. As the fittings further serve as hinge fittings of the openable panels, an additional standardization is obtained, as all panels can then be prepared for opening and only at a relatively late stage during the project is it necessary to decide whether the individual panel is to be openable or fixed.

With this background it is an object of the present invention to provide a window system of the kind stated in the introduction, in which an increased standardization and modulation of the production becomes more feasible, and the installation at the building site is facilitated.

In a first aspect of the invention, this object is achieved by a window system, in which each bracket unit furthermore comprises at least one supplemental element adapted to be detachably connected to said base element.

By providing a supplemental element, the desired functionality aimed at needs not be included in the base element. Thus, the base element may in principle be common to all bracket units of the bracket arrangement. Each bracket unit may be tailor-made to the intended use as regards the installation situation of the window system itself in the roof structure, which may be of varying character, and in relation to other elements placed in the roof, for instance relative to other window systems. This makes it possible to fit the window system into the roof structure, both when installing it as a stand-alone window system, and also when the position must be adapted to surrounding structures.

In a preferred embodiment said at least one supplemental element comprises a leg element adapted to be detachably connected to the base element, preferably rotatably and detachably connected with the base element. In this manner, the functionality of providing the mounting means may be adapted to the particular conditions at the installation site. In the preferred development, the rotatable and detachable connection makes it possible to adjust the inclination of the window and accommodate tolerances by rotating the leg element relative to the base element. This is particularly applicable in structural skylights mounted on an upstand, in which the two sides of the upstand on which the top and bottom of the window rest have different heights, thereby defining the angle of the window, and in so-called ridge constellations, in which two windows meet top-to-top resting on a beam and with the bottoms resting on opposite upstands.

In order to keep the base element and other supplemental elements as simple and universally applicable as possible, the leg element may be adapted to be connected to the base element by means of an adaptor element. That is, only in such installation positions requiring further functionalities to be incorporated into the bracket unit by means of a particularly designed adaptor element.

The bracket unit may be adapted to varying installation conditions in many ways. In one embodiment, said leg element includes fastening means for connection to the roof structure, preferably comprising at least one depending folded portion and/or a plurality of apertures. The depending folded portion or portions may be positioned in abutment with a beam placed on the upstand. Further fastening means such as screws may be inserted through the apertures.

In a further embodiment, said at least one supplemental element comprises a spacer element. This makes it possible to provide for the space needed between window systems positioned on top of each other during storage or transportation and protect the window systems by transmitting the weight of the upper window system or systems to the lower window system or systems via the base elements of the bracket units, without parts of the frame structure or other parts of the window system coming into contact with each other.

In a further embodiment, which facilitates positioning several windows on top of each other, the spacer element has an upper end and a lower end, the upper end and the lower end being provided with engagement means, the respective engagement means at the upper end and the lower end being complementary to each other.

In a still further embodiment, said at least one supplemental element comprises a lifting element. The lifting device may for instance be adapted for engagement with a lifting device such as a crane. This makes it possible to lift the entire window system once lifting elements have been attached to the respective base element at a number of bracket units.

The window system according to the invention may assume a number of states represented by the character of the supplemental element or elements connected to the base element. In a state of storage it includes a supplemental element comprising a spacer element; in a state of delivery it includes a supplemental element comprising a lifting element; and in a state of use it includes a leg element, preferably rotatably connected to the base element. Several supplementary elements may be attached to the base element at the same time.

In a particular embodiment, which is suited for window systems mounted in a ridge constellation, the base element includes engagement means, said engagement means being adapted to be connected to a supplemental element constituted by the base element of another window system positioned opposite or next to the window system, the base element of said another window system being provided with engagement means complementary to the engagement means of the base element of the window system.

In a further development of the particular embodiment, the adaptor element is provided with engagement means complementary to the engagement means of the base element.

In a second aspect of the invention, a method of installing a window system in a roof structure is provided. The method comprises the steps of:

providing a substantially rectangular frame structure with four corner sections, providing a bracket arrangement comprising a set of bracket units, each bracket unit including a base element, mounting the base element of each bracket unit at each corner section of the frame structure, selecting at least one supplemental element from the group comprising a leg element, an adaptor element, a spacer element, a lifting element, and the base element of another window system, connecting the at least one supplemental element detachably to the base element, optionally detaching one or more supplemental element, and installing the window system in the roof structure.

Further details are described, and further advantages stated, in the description of particular embodiments of the invention.

In the following the invention will be described in further detail by means of examples of embodiments with reference to the schematic drawings, in which FIG. 1 is a perspective view of a window system in an embodiment of the invention;

Figure 1:
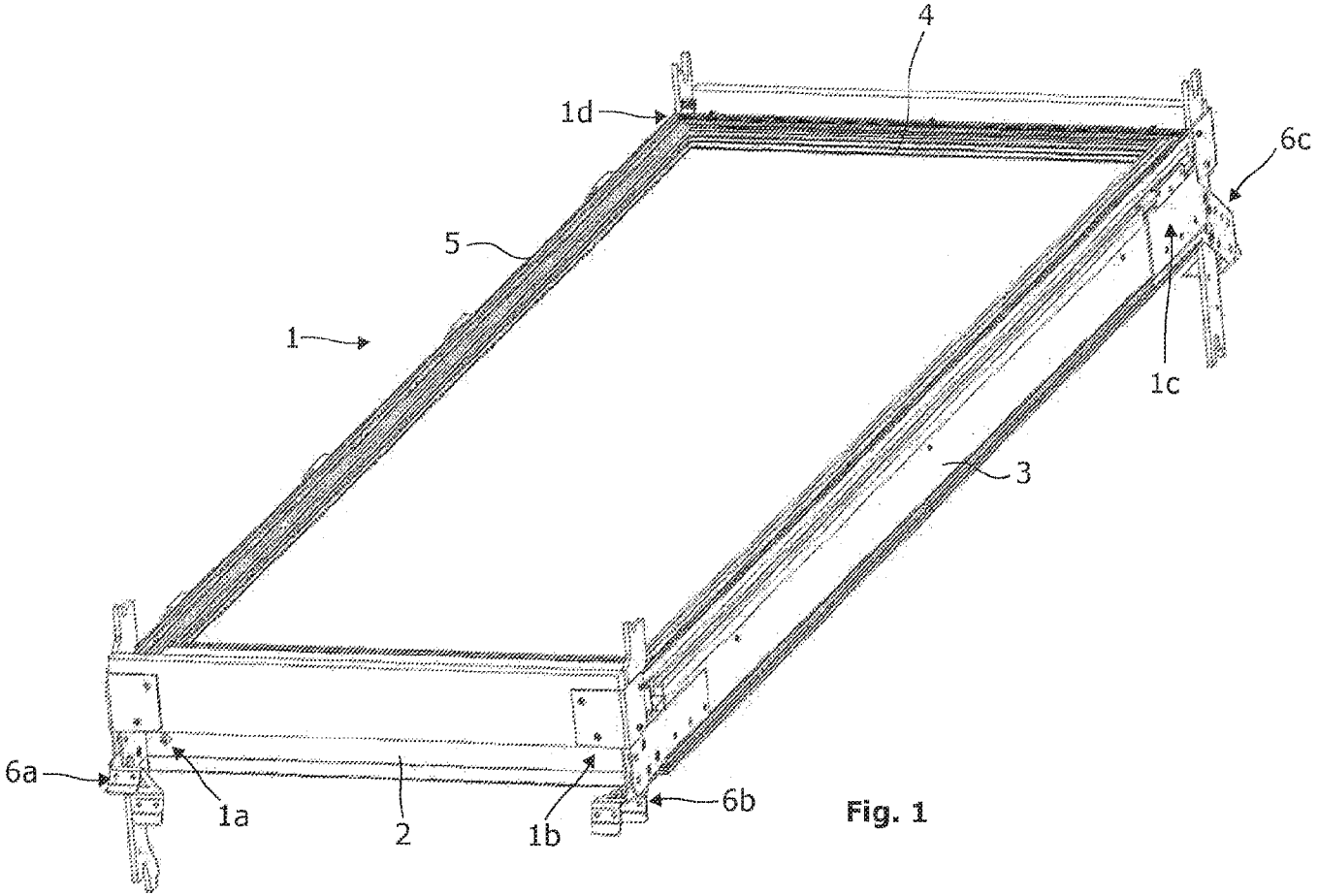

In the several views of the drawings, an embodiment of a window system according to the invention is shown. The window system comprises a substantially rectangular frame structure generally designated 1; apart from this feature, the design of the window system is arbitrary and may for instance take the form of a panel system comprising a frame and sash combination, in which the sash carries a pane and may be opened for ventilation or smoke evacuation purposes, or fixed, that is, not openable relative to the frame structure. Other conceivable designs include a non-transparent or partially transparent panel element such as a solar panel.

The frame structure 1 of the window system has four corner sections 1*a*, 1*b*, 1*c* and 1*d* and is adapted to be installed in a roof structure (not shown). In the embodiment shown, the frame structure 1 is composed by four frame members 2, 3, 4 and 5, extending between respective corner sections; however, the frame structure may also be a coherent structure. The window system furthermore comprises a bracket arrangement comprising a set of bracket units 6*a*, 6*b*, 6*c* and 6*d*. According to the main principle underlying the present invention, each bracket unit includes a base element 10*a*, 10*b*, 10*c* and 10*d* mounted at the respective corner section 1*a*, 1*b*, 1*c* and 1*d* of the frame structure 1. Additionally, each bracket unit comprises at least one supplemental element adapted to be detachably connected to the base element. The individual configuration of each bracket unit of the embodiment shown will be described in detail further down. In this description, terms such as "lower", "upper", "left-hand", "right-hand", "side", "top", "bottom", etc. refer to the shown position of the window system only, and is not to be interpreted as limiting the window system to use in a particular position.

Referring now in particular to FIGS. 1 to 5, one such supplemental element comprises, in the embodiment shown, a leg element 20*a*, 20*b*, 20*c*, 20*d* which in the shown state is connected to the respective base element 10*a*, 10*b*, 10*c* and 10*d* in a manner which is rotatable and detachable, that is the leg element may be connected and disconnected from the base element by suitable connection means and is able to rotate about an axis of rotation relative to the base element.

In the bracket unit 6*a* positioned in the corner section 1*a* in the lower left-hand corner of the frame structure, at the intersection between the bottom frame member 2 and one side member 5, the base element 10*a* is formed by two substantially plate-shaped parts 11*a*, 12*a* such that they together surround the intersection in the corner section 1*a* and protrude from the frame structure in a plane substantially parallel to that of the frame side member 5. The base element 10*a* could also be formed as a one-part element. At a distance from the bottom frame member 2, the leg element 20*a* is connected to the base element 10*a* in a hinge connection including a bolt 21*a* and matching apertures (not shown) in the base element 10*a* and hinge portion 22*a* of the leg element 20*a*. The leg element 20*a* furthermore includes fastening means for connection to the roof structure. In the embodiment shown, the fastening means include two portions 24*a* and 25*a* formed as folded portions depending from abutment portion 23*a* and a plurality of apertures in the folded depending portions. This embodiment is particularly useful in installation conditions involving a beam, for instance positioned on an upstand made to that purpose in a roof.

Figure 2:
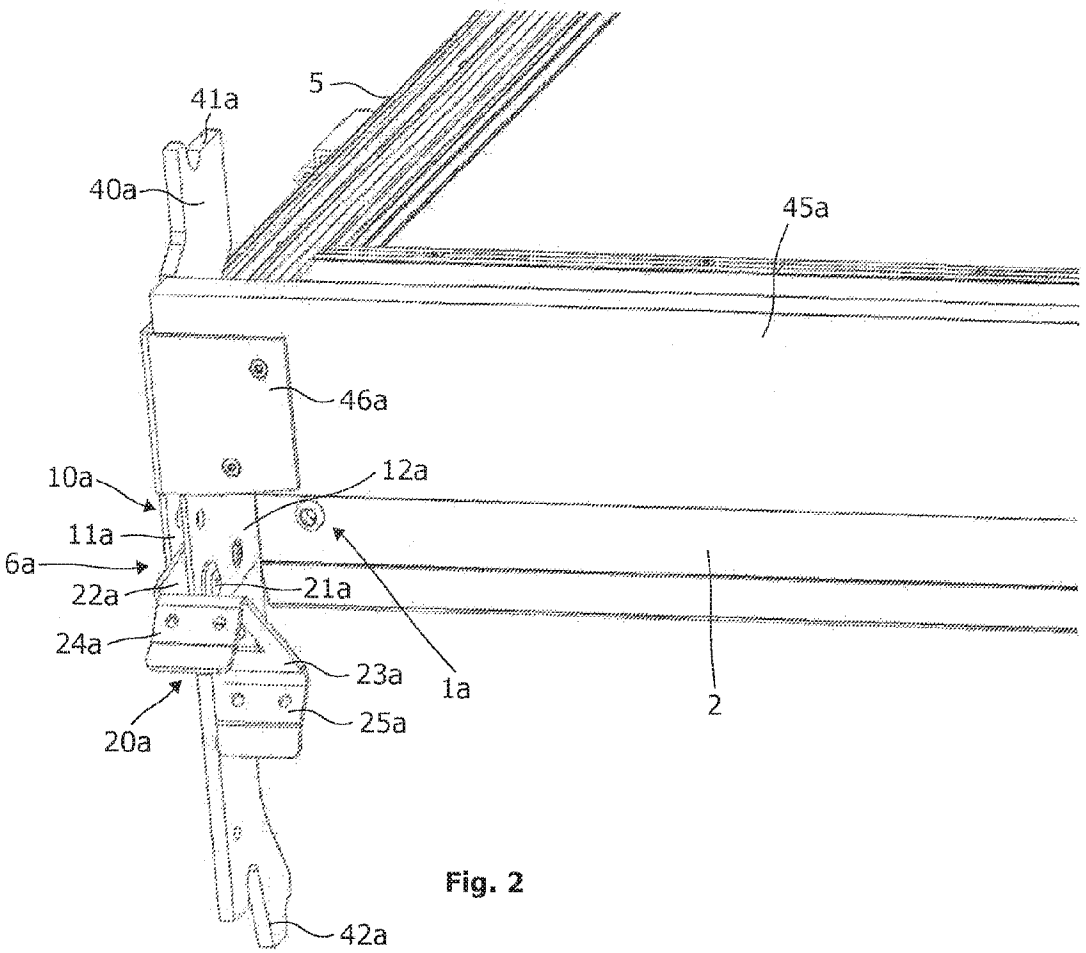
FIG. 2 is a partial perspective view, on a larger scale of the lower left-hand corner part of the window system shown in FIG. 1.
Figure 3:
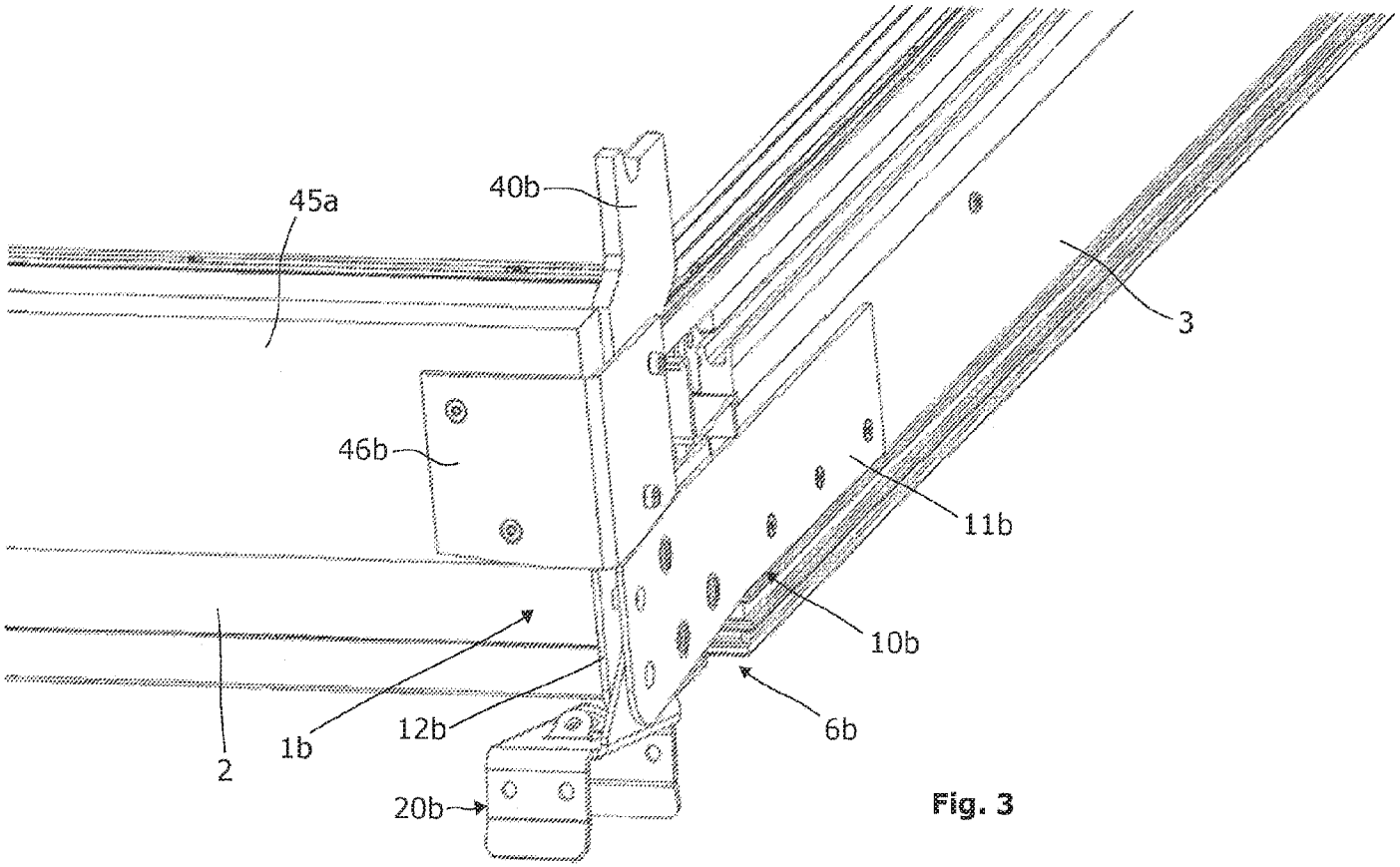
FIG. 3 is a partial perspective view, on a larger scale of the lower right-hand corner part of the window system shown in FIG. 1.

As shown in FIG. 3, the base element 10*b* and the leg element 20*b* of the bracket unit 6*b* of the lower right-hand corner are configured in manner corresponding to that of bracket unit 6*a*. In FIGS. 2 and 3, the window system is shown in a state of storage, in which the window system is adapted to be positioned in a stack of similar window systems, for instance up to six window systems. To that end, a supplemental element comprising a spacer element 40*a* and 40*b*, respectively, is connected to the respective base element 10*a* and 10*b* in a detachable manner, for instance by bolts (not described in detail). The spacer elements 40*a*, 40*b*—together with corresponding spacer elements at the top of the window system—provide for the space needed between window systems positioned on top of each other and protect the window systems by transmitting the weight of the upper window system or systems to the lower window system or systems via the base elements of the bracket units, without parts of the frame structure or other parts of the window system coming into contact with each other. Each spacer element has an upper end and a lower end, the upper end 41*a* and the lower end 42*a* of the spacer element 40*a* of the lower left-hand corner section 1*a* being provided with engagement means, the respective engagement means at the upper end and the lower end being complementary to each other. The spacer element 40*b* at the lower right-hand corner section 1*b* may have a similar configuration, or as shown, a lower end 42*b* ending at the base element 10*b*. The spacer elements 40*a* and 40*b* are connected to each other by means of a transverse bar member 45*a* by means of suitable fittings 46*a*, 46*b*.

Figure 4:
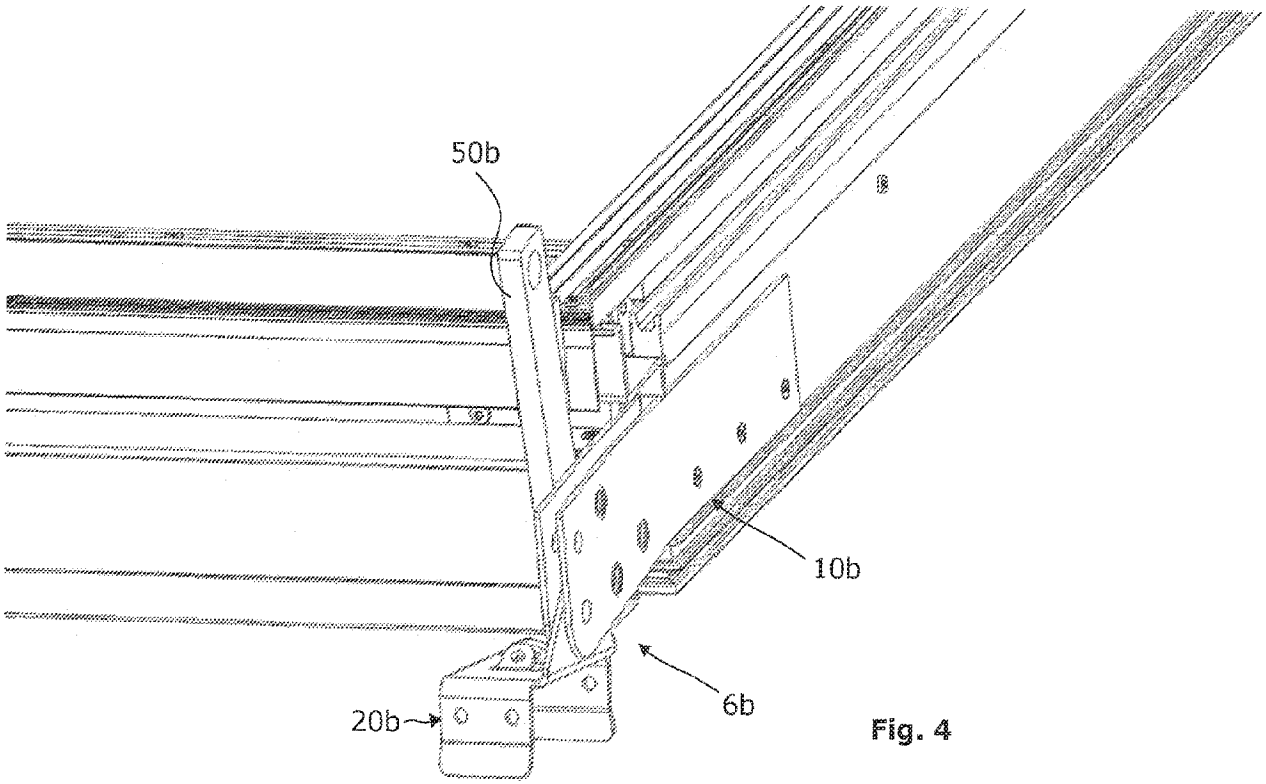
FIG. 4 is a view corresponding to FIG. 3, in another state with some parts of the window system in the embodiment shown removed.
Figure 5:
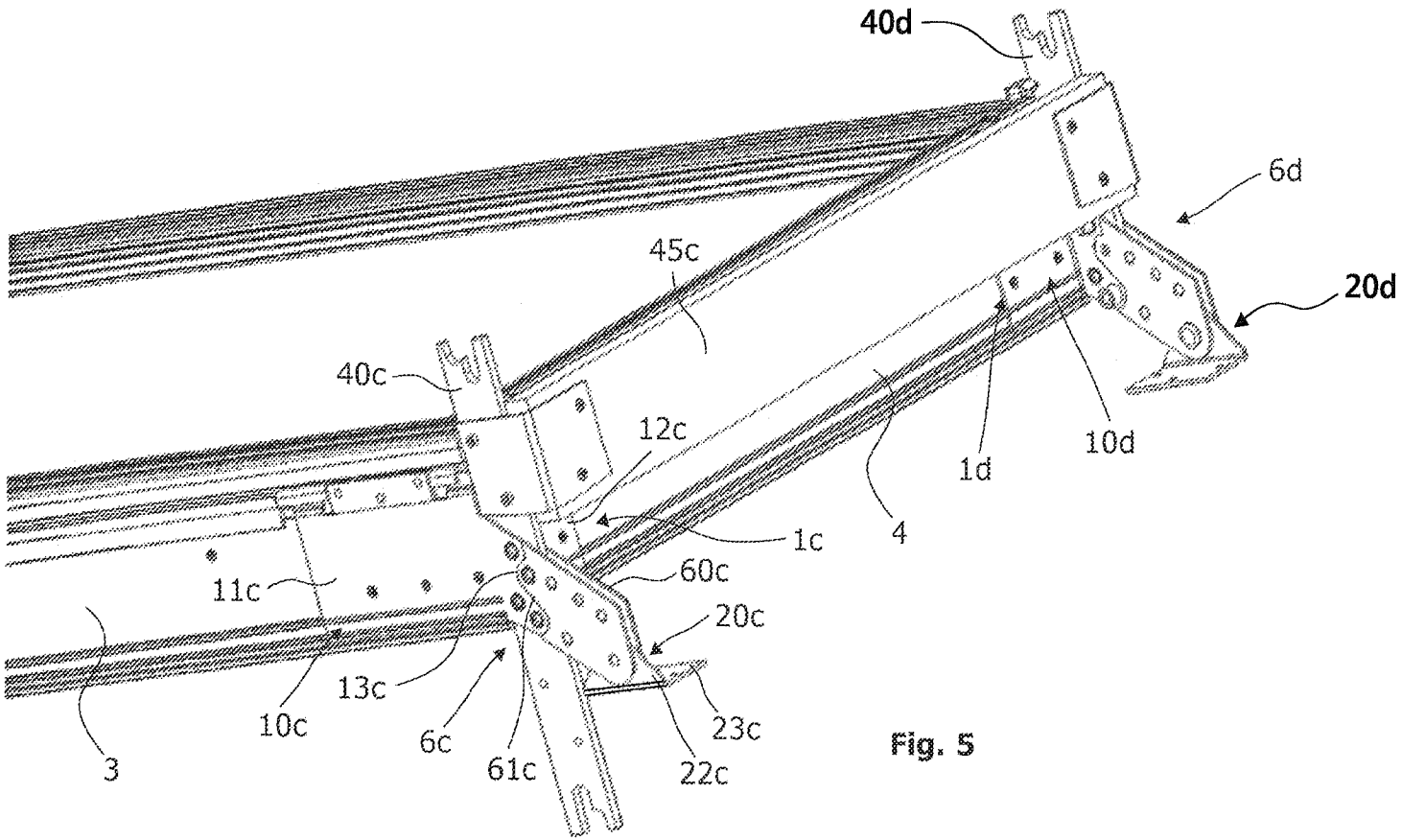
FIG. 5 is a partial perspective view, on a larger scale of the top part of the window system shown in FIG. 1.

In FIG. 4, showing the lower right-hand corner of the window system, the window system is shown in a state of delivery, in which the spacer elements 40*a* and 40*b* have be detached from the respective base element 10*a* and 10*b*. Another supplemental element connected detachably to the base element 10*b* is shown in this Figure, namely a lifting element 50*b*. Together with corresponding lifting elements in the other corner sections of the window system, this makes it possible to lift the entire window system by means of suitable hoisting means, from the place of delivery, typically on the ground at the building site, or directly from a delivery lorry, up to the roof.

In principle, all base elements of the window system could be formed in an identical manner, and be provided with one or more supplemental elements to adapt the bracket unit to its specific purpose. However, in the embodiment shown, the bracket units 6*a*, 6*b* at the bottom part of the window system are substantially identical, and the bracket units 6*c*, 6*d* at the top correspond to each other but slightly are different from bracket units 6*a*, 6*b* at the bottom part. Referring now to FIGS. 5 to 9, the top part of an embodiment of the window system will be described in detail.

In the embodiment shown in these Figures, the bracket units 6*c* and 6*d* correspond to each other and only the bracket unit 6*c* will be described in detail. The base element 10*c* comprises two plate-shaped parts 11*c*, 12*c* and is connected to a leg element 20*c*. However, as opposed to the bracket units 6*a*, 6*b* at the bottom part of the window system the leg element 20*c* is connected to the base element 10*c* by means of an adaptor element 60*c*. The adaptor element 60*c* is provided with engagement means 61*c* complementary to engagement means 13*c* of the base element 10*c*. Additional fastening may be provided, for instance in the form of detachable bolts 62*c* and 62*d*. The leg element 20*c* is provided with a hinge portion 22*c* hingedly and detachably connected to the adaptor element 60*c* by a bolt 31*c* and is provided with fastening means in the form of abutment portion 23*c* and a number of suitable apertures.

As at the bottom part of the window system, the bracket units 6*c*, 6*d* at the top are provided with spacer elements 40*c*, 40*d* at each end of transverse bar 45*c*.

Figure 6:
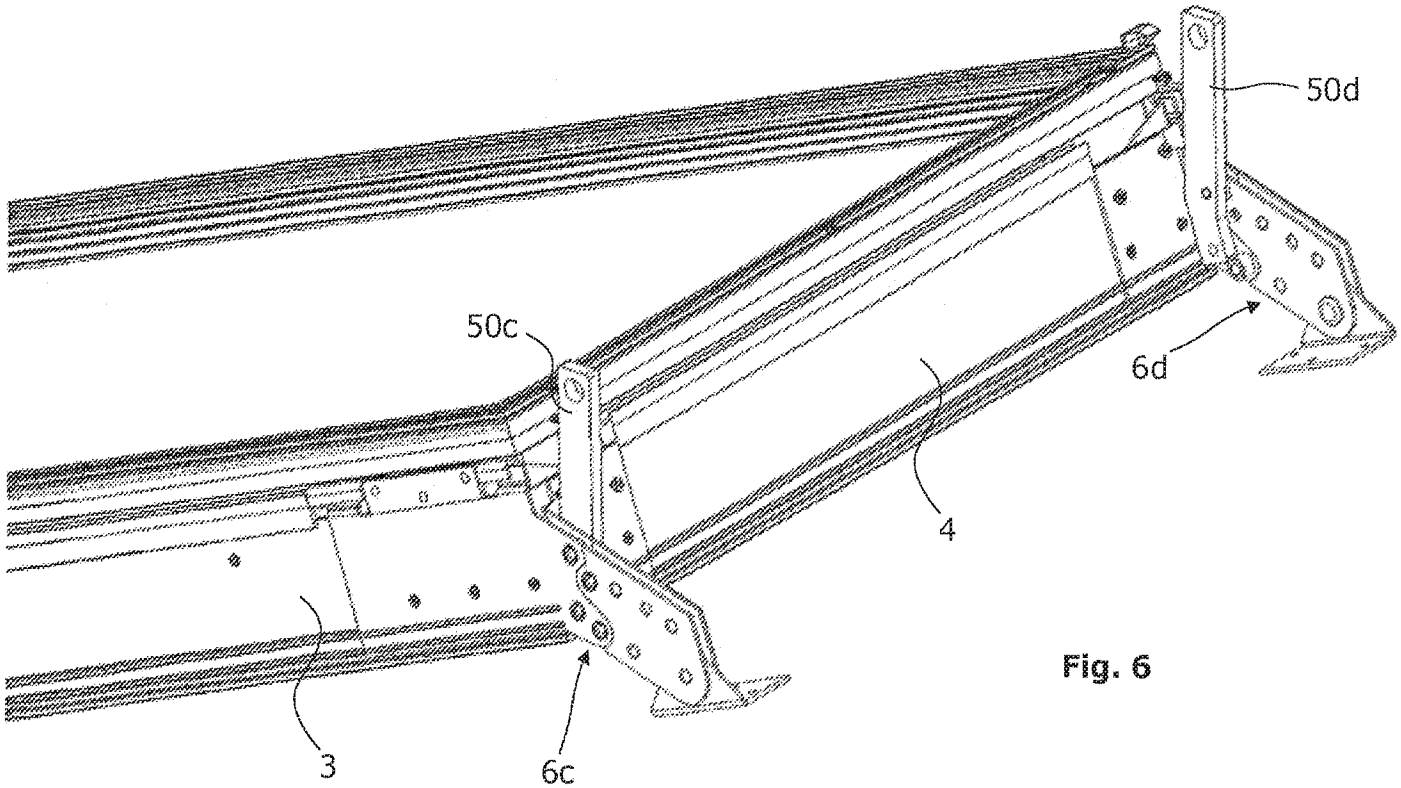
FIG. 6 is a view corresponding to FIG. 5, from a different angle.
Figure 7:
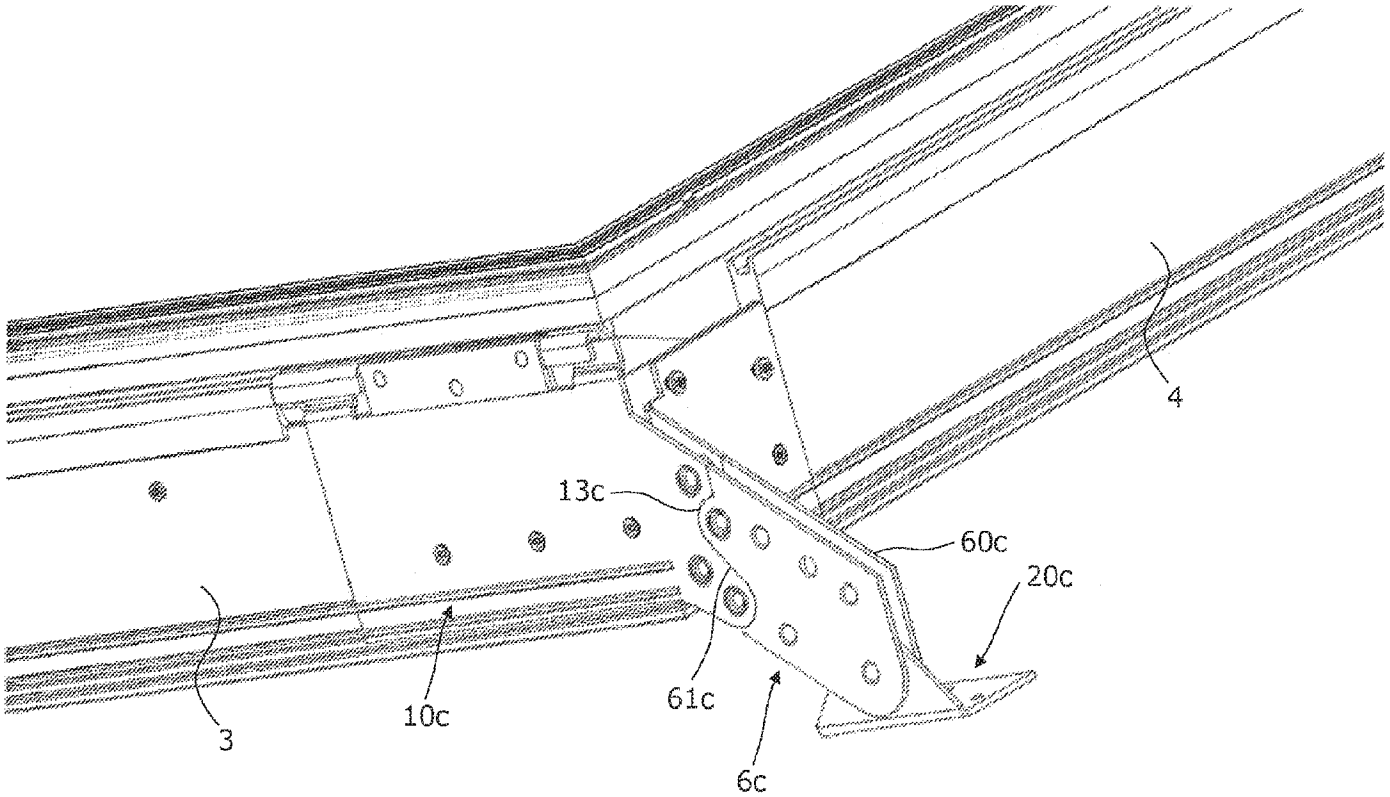
FIG. 7 is a partial perspective view on a larger scale, in another state with some parts of the window system in the embodiment shown removed.

Referring to FIG. 6 showing the window system in a state of delivery, the spacer elements 40*c*, 40*d* and transverse bar 45*c* have been removed, and lifting elements 50*c*, 50*d* are visible. When the window system has thus been delivered and lifted up to the installation site, the lifting element 50*c* and the remaining lifting elements are removed thus attaining the state in FIG. 8, in which the window system is ready to be fastened to the underlying roof structure and reach its built-in position of use. During the adaptation to the underlying roof structure, the leg elements 20*a*-20*d* are adjusted relative to the base elements 10*a*-10*d* to accommodate inclination, tolerances etc.

Figure 8:
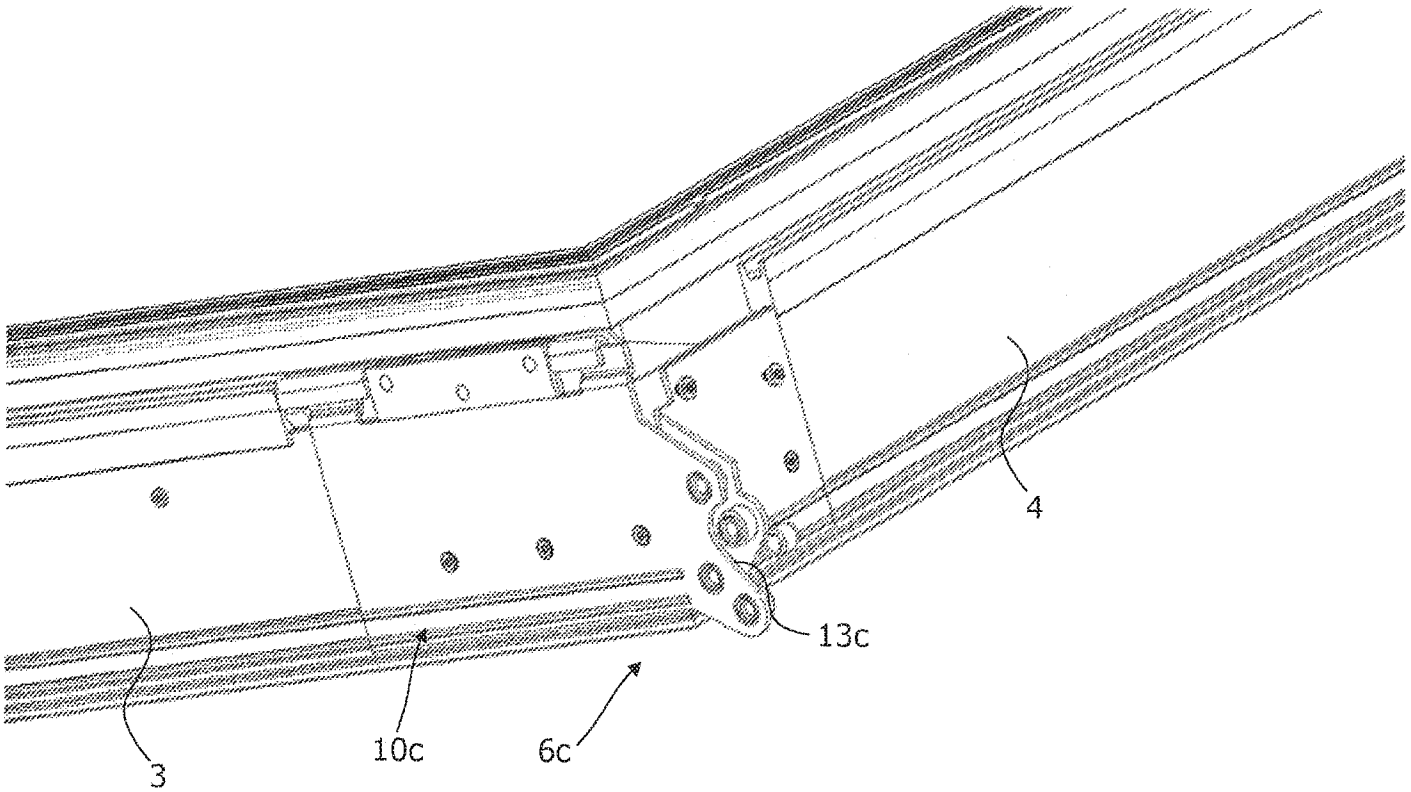
FIG. 8 is a view corresponding to FIG. 7, in another state with some parts of the window system in the embodiment shown removed.
Figure 9:
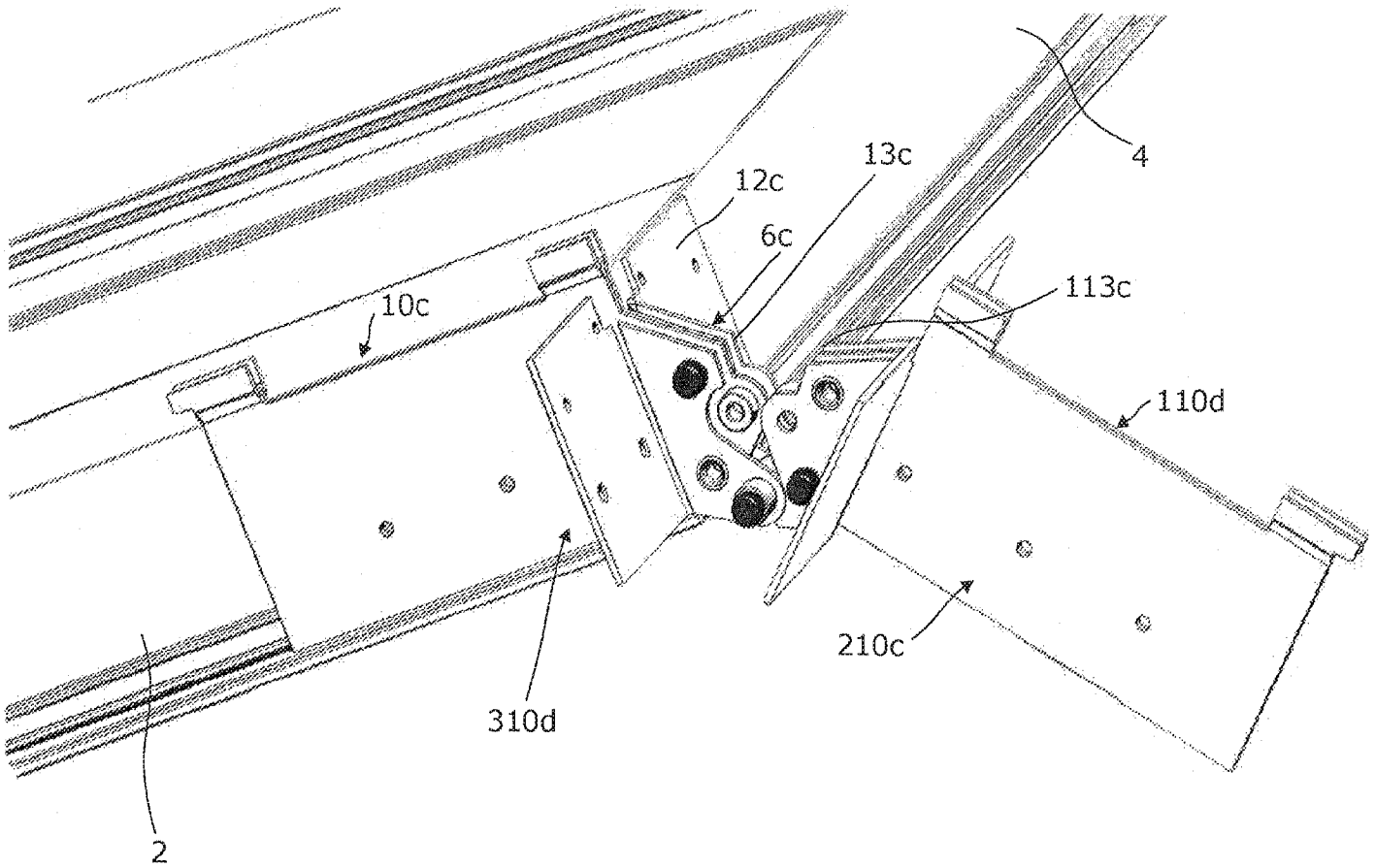
FIG. 9 is a perspective view, on a larger scale of a window system in an embodiment of the invention and details of corresponding window systems interacting with the window system shown.

Referring in particular to FIGS. 8 and 9, a particular use of the window system according to the invention is shown. As shown, the bracket unit 6*c* is shown in a basic condition, i.e. comprising only base element 10*c* including its engagement means 13*c*. The engagement means 10*c* are adapted to be connected to a supplemental element constituted by the base element 110*d* of another, second window system positioned opposite to the window system shown, to the base element 310*d* of a third window system next to the first window system, and to the base element 210*c* of a fourth window system opposite the third and next to the second, thus making interconnection of four window systems possible. In the embodiment shown, the respective engagement means are complementary to each other.

Referring now to FIGS. 10 to 18, details of alternative embodiments of a bracket arrangement are shown. Parts having the same or analogous function as in the embodiment of FIGS. 1 to 9 carry the same reference numerals to which 500 has been added.

Figure 10:
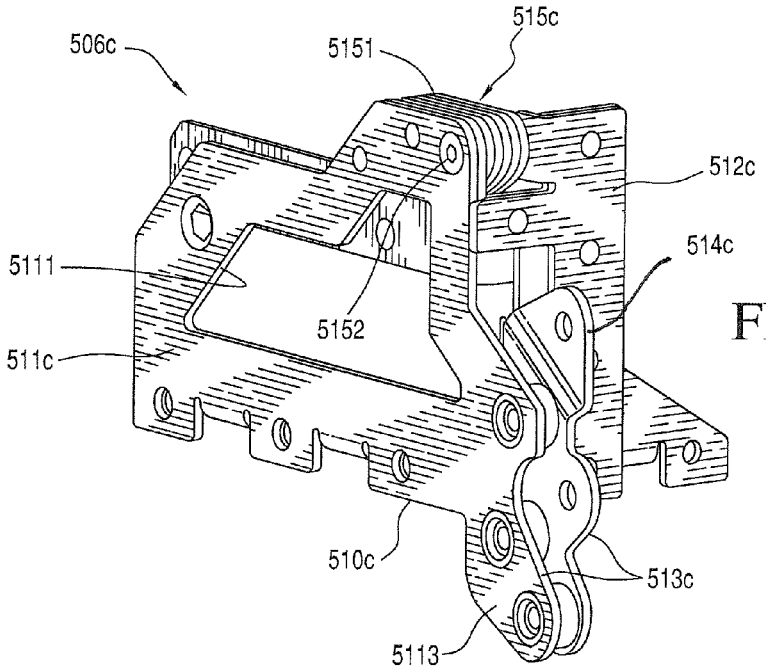
FIGS. 10 to 12 show perspective views, from different angles, of a further embodiment of a bracket unit including a hinge element.
Figure 11:
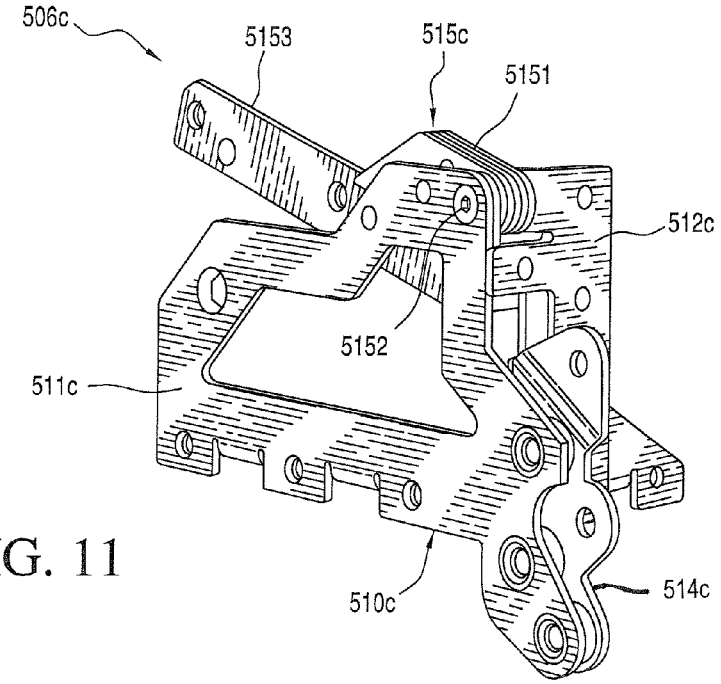
Figure 12:
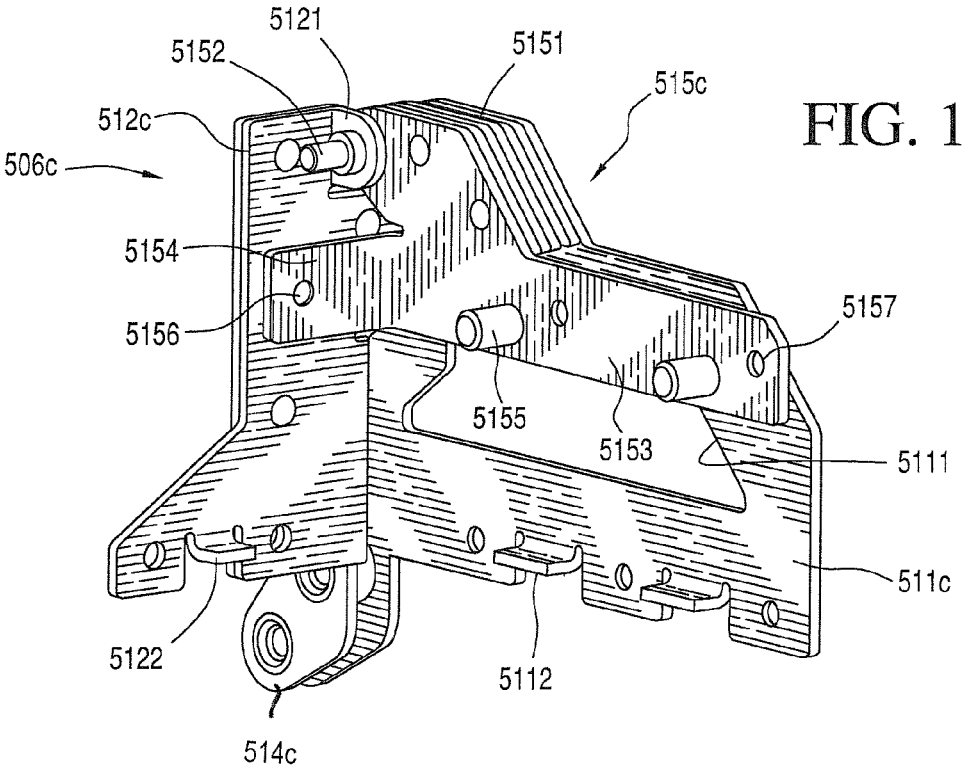

Each of FIGS. 10 to 12 shows a bracket unit 506*c* adapted to be connected to the top left-hand corner section of the frame structure. It is understood that a bracket unit for connection to the top right-hand corner has a corresponding, although mirror-inverted configuration. Bracket units at the bottom of the window system may have a similar configuration, or as in the embodiment of FIGS. 1 to 9.

The bracket unit 506*c* is provided with a base element 510*c* comprising two plate-shaped parts 511*c*, 512*c* at an angle relative to each other. Furthermore, engagement means 513*c* are formed on the base element 510*c*, in the embodiment shown as a protruding portion 5113 of plate-shaped part 511*c* parallel to a separate plate 514*c* connected to plate-shaped part 512*c*. This plate 514*c* could also be formed as an integral portion of plate-shaped part 512*c*. Plate-shaped part 511*c* is provided with a central incision 5111 which serves to save material and hence weight. Plate-shaped parts 511*c* and 512*c* are provided with respective flange portions 5112 and 5122 in a common plane corresponding to the under side of the frame.

Figure 13:
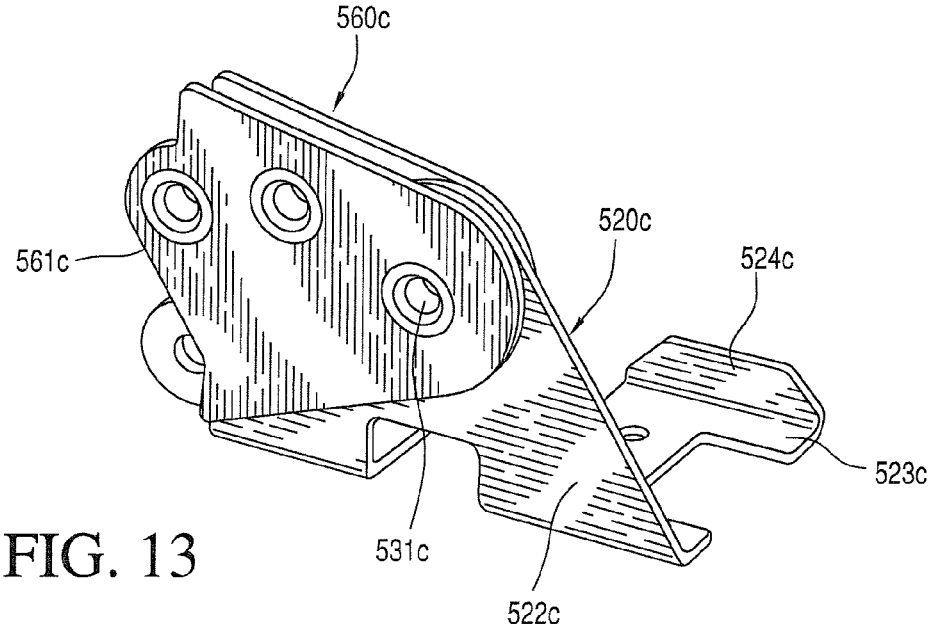
FIGS. 13 and 14 show perspective views from two different angles, of another embodiment of a leg element and adaptor element.
Figure 14:
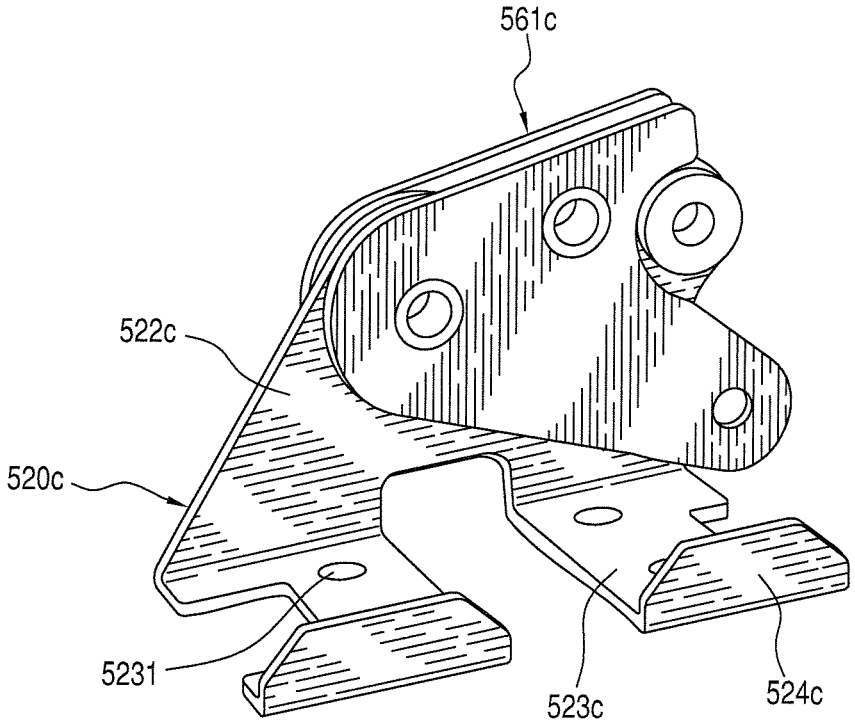

FIGS. 13 and 14 show a leg element 520*c* for connection to the base element 510*c* via an adaptor element 560*c*. The adaptor element 560*c* is provided with engagement means 561*c* complementary to engagement means 513*c* of the base element 510*c*. Additional fastening may be provided, for instance in the form of detachable bolts (not shown). The leg element 520*c* is provided with a hinge portion 522*c* connected to the adaptor element 560*c* by means of a collar 531*c* providing a pivotal joint. Leg element 520*c* is furthermore provided with an abutment portion 523*c* and upstanding flange portions 524*c*, a number of suitable apertures 5231 for the reception of fastening means for connection to a subjacent roof structure being provided in the abutment portion 523*c*.

As in the embodiments of FIGS. 1 to 9, leg element 520*c* and the corresponding leg elements at the other corners of the window are adjusted relative to the respective base element, here base element 510*c* to accommodate inclination, tolerances etc during the adaptation to the underlying roof structure.

Returning to FIGS. 10 to 12, a supplemental element in the form of hinge element 515*c* in a first embodiment is shown. Hinge element 515*c* is adapted to be connected to a sash in a panel system comprising a frame and sash combination, in which the sash carries a pane and may be opened for ventilation or smoke evacuation purpose. Other conceivable designs include a non-transparent or partially transparent panel element.

The hinge element 515*c* comprises a head section 5151 including an opening (not shown) for accommodation of a hinge pin 5152 received in an opening provided in a flange portion 5121 of the plate-shaped part 512*c*. A first engagement leg 5153 is adapted to be connected to the side members of sash (not shown) and a second engagement leg 5154 perpendicular to the first engagement leg 5153 adapted to be connected to the top member of the sash. The first engagement leg 5153 is provided with spigots 5155 to be received in corresponding bores in the side members of the sash. Once the spigots 5155 have been inserted in the corresponding bores in the sash, fastening means such as screws are introduced into aperture 5156 in the second engagement leg 5154 and apertures 5157 of the first engagement leg 5153.

In the embodiment shown, the hinge element 515*c* is configured as a number of sheets of a suitable material, such as steel, which are bolted or riveted together. The number of sheets is chosen to attain appropriate strength. However, other configurations are conceivable, such as a one-piece molded element.

Hinge element 515*c* can rotate approximately ninety degrees from the position shown in FIG. 10 in which first engagement leg 5153 would extend vertically. When the hinge element 515*c* is fully rotated from the position shown in FIG. 10 to a position in which first engagement leg 5153 extends vertically, an installer can readily access apertures 5156 and 5157 to attach hinge element 515*c* to a sash using any suitable fastener (e.g., screws) while hinge element 515*c* is connected to base element 510*c*. It should be readily appreciated that hinge element 515*c* may be attached to the sash prior to the hinge element 515*c* being connected to base element 510*c*.

As shown in the positions shown in FIGS. 10 and 11, respectively, the hinge element 515*c* and hence the not-shown sash is able to assume an angle relative to the base element 510*c* connected to the frame when pivoting about hinge pin 5152 within a suitable opening range of the sash.

Alternative embodiments of the hinge element are shown in FIGS. 15 and 16, and 17 and 18, respectively. Details having the same or analogous function as in the embodiment of FIGS. 10 to 13 carry the same reference numerals to which 100 and 200, respectively, have been added.

Figure 15:
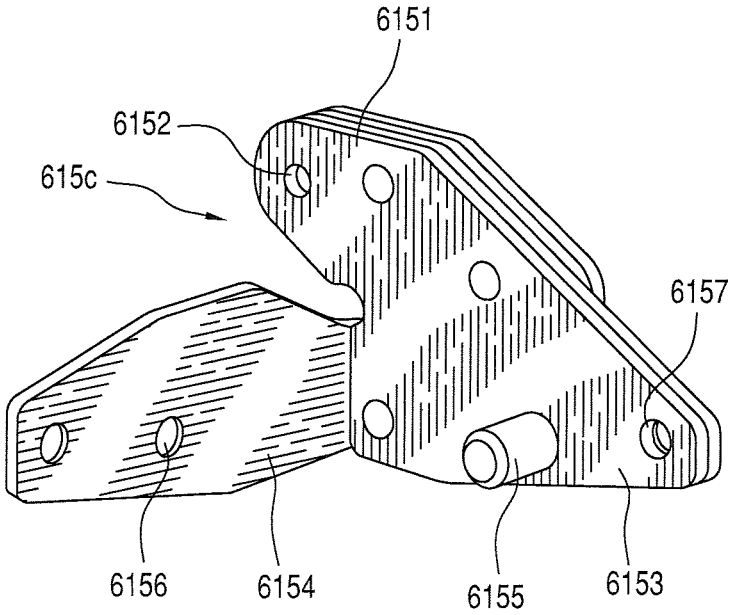
FIGS. 15 and 16 show perspective views from two different angles, of a still further embodiment of a hinge element.
Figure 16:
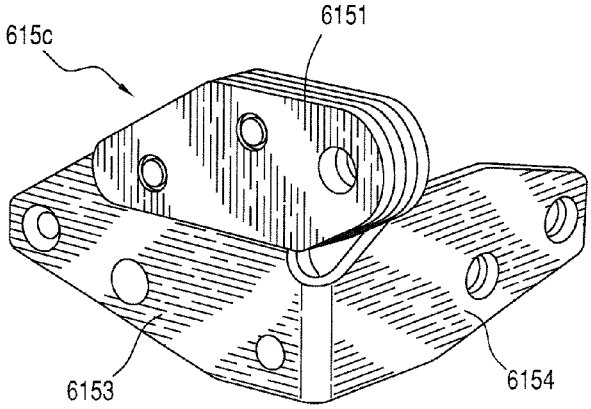

Hinge element 615*c* of FIGS. 15 and 16 has a general configuration corresponding to hinge element 515*c* of the above embodiment, with a head portion 6151 and hinge joint 6152, a first engagement leg 6153 provided with a spigot 6155, however only one, and aperture 6157, and a second engagement leg 6154 with aperture 6156.

Figure 17:
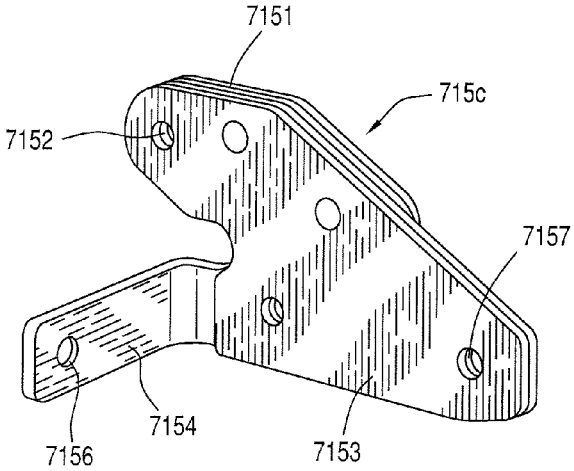
FIGS. 17 and 18 show perspective views from two different angles, of an alternative embodiment of a hinge element.
Figure 18:
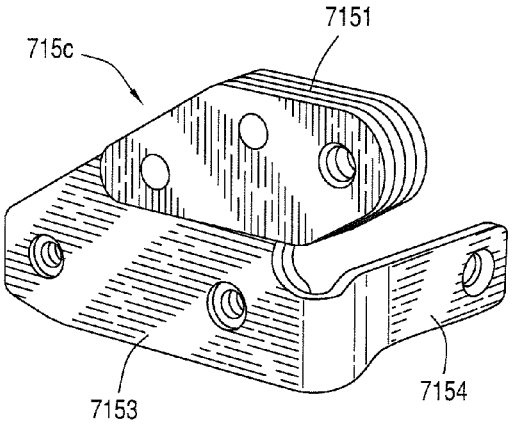

Correspondingly, hinge element 715*c* of FIGS. 17 and 18 has a head portion 7151 with hinge joint 7152, a first engagement leg 7153 without spigot, and apertures 7157 serving as the only connecting means, and second engagement leg 7154 with aperture 7156.

Both the second and the third embodiment of the hinge elements are of a more simple design than the first embodiment shown in FIGS. 10 to 12.

The window system according to the invention may be used for many different geometrical configurations, e.g. as structural skylights abutting upstands such as an array of long lights forming a light band and ridge constellations.

The invention should not be regarded as being limited to the embodiments shown in the drawings and described in the above. Various modifications and combinations may be carried out within the scope of the appended claims.

The invention claimed is:

1. A window system comprising:

a frame structure being adapted to be installed in a roof structure; and, a bracket arrangement comprising a set of bracket units, the set of bracket units include a first bracket unit having a base element connected to a first portion of said frame structure, said first bracket unit further including a hinge element being configured to move relative to said base element, said hinge element further being adapted to be connected to a sash wherein said hinge element allows the sash to move relative to said frame structure and said base element when said frame structure is installed in a roof structure, and said hinge element including connecting means for facilitating attachment of a sash to at least a portion of said hinge element.

2. The window system of claim 1, wherein:

said hinge element is pivotally connected to said base element.

3. The window system of claim 1, wherein:

said frame structure is generally rectangular in shape and includes four frame members forming four corner sections; and, said first bracket unit includes a first generally plate-shaped part connected to a first frame member and a second generally plate-shaped part connected to a second frame member wherein said first frame member and said second frame member form one of said four corner sections.

4. The window system of claim 3, wherein:

the hinge element is pivotally mounted between said first generally plate-shaped part and said second generally plate-shaped part.

5. The window system of claim 3, wherein:

said hinge element includes a first engagement portion configured to engage a first side of a sash and a second engagement portion configured to engage a second side of a sash.

6. The window system of claim 5, wherein:

said first side of the sash is positioned at approximately a ninety degree angle to said second side of the sash.

7. The window system of claim 1, wherein:

said hinge element includes a first leg and a second leg, said connecting means includes at least one aperture formed in at least one of said first leg and said second leg.

8. The window system of claim 7, wherein:

said connecting means further includes at least one peg extending from one of said first leg and said second leg, said at least one peg is configured to be inserted into a corresponding bore formed in the sash.

9. The window system of claim 1, wherein:

said first bracket unit includes engagement means for detachably connecting at least one supplemental element to said base element.

10. The window system of claim 9, wherein:

said at least one supplemental element includes an adaptor detachably connected to said base element and a leg element adjustably connected to said adaptor.

11. The window system of claim 10, wherein:

said leg element includes a hinge portion connected to said adaptor, an abutment portion and at least one flange extending upwardly from said abutment portion.

12. A bracket unit for a window system having a frame and a sash carrying at least one pane, the sash being moveable relative to the frame when the frame is installed in a roof structure, said bracket unit comprising:

a base element adapted to be connected to a first portion of the frame, said bracket unit further including a hinge element being configured to move relative to said base element, said hinge element further being adapted to be connected to a sash wherein said hinge element allows the sash to move relative to the frame and said base element when the frame is installed in a roof structure, and said hinge element including a head portion, a first engagement leg and a second engagement leg, said first engagement leg is positioned at an angle relative to said second engagement leg, said first engagement leg and said second engagement leg are configured to engage different sides of a sash.

13. The bracket unit of claim 12, wherein:

said base element includes a first generally plate-shaped part and a second generally plate-shaped part, said first generally plate-shaped part is positioned at an angle relative to said second generally plate-shaped part; and, said hinge element is pivotally connected to said base element.

14. The bracket unit of claim 13, wherein:

said first engagement leg and said second engagement leg are configured to directly engage different sides of the sash.

15. The bracket unit of claim 14, wherein:

each of said first engagement leg and said second engagement leg includes connecting means for connecting said hinge element to a sash.

16. The bracket unit of claim 14, wherein:

said head portion includes an aperture for receiving a hinge pin allowing said hinge element to rotate at least forty-five degrees relative to said base element.

17. The bracket unit of claim 14, wherein:

said head portion of said hinge element is positioned between said first generally plate-shaped part and said second generally plate-shaped part.

18. The bracket unit of claim 17, further including:

engagement means for detachably connecting at least one supplemental element to said base element, said at least one supplemental element includes an adaptor detachably connected to said base element and a leg element adjustably connected to said adaptor, said leg element includes a hinge portion connected to said adaptor, an abutment portion and at least one flange extending upwardly from said abutment portion.

19. The bracket unit of claim 18, wherein:

said engagement means is formed at least in part by a protruding portion of said first generally plate-shaped part and a third generally plate-shaped part extending from said second generally plate-shaped part, said first generally plate-shaped part extends substantially parallel to said third generally plate-shaped part and substantially perpendicular to said second generally plate-shaped part.

20. The bracket unit of claim 13, wherein:

at least one of said first generally plate-shaped part and said second generally plate-shaped part include a flange disposed to engage an underside of the frame when said first bracket unit is connected to the frame.

21. A bracket unit for a window system having a frame and a sash carrying at least one pane, the sash being moveable relative to the frame when the frame is installed in a roof structure, said bracket unit comprising:

a base element adapted to be connected to a first portion of the frame, said bracket unit further including a hinge element being configured to move relative to said base element, said hinge element further being adapted to be connected directly to a sash wherein said hinge element allows the sash to move relative to the frame and said base element when the frame is installed in a roof structure.

* * * * *